United States Patent [19]

Berry et al.

[11] 4,083,542

[45] Apr. 11, 1978

[54] OXYGEN LANCE ASSEMBLY

[75] Inventors: William W. Berry, Pittsburgh; Leo L. Meinert, Beaver; Nicholas M. Rymarchyk, Pittsburgh, all of Pa.

[73] Assignee: Pullman Berry Company, Harmony, Pa.

[21] Appl. No.: 795,246

[22] Filed: May 9, 1977

[51] Int. Cl.[2] ..... C21C 5/32

[52] U.S. Cl. ..... 266/225

[58] Field of Search ..... 266/225, 226; 239/132.3

[56] References Cited

U.S. PATENT DOCUMENTS 3,972,515 8/1976 Mercatoris ..... 266/225

*Primary Examiner*—Gerald A. Dost

*Attorney, Agent, or Firm*—Thomas G. Anderson

[57] ABSTRACT

An oxygen lance includes a top connector and support member which is provided with oxygen and water inlet and outlet pipes connected to an upper connector plate assembly having a flat plate surface with a plurality of openings. A lower connector assembly is connected to the upper connector assembly by quick disconnect clamping means. The lower connector assembly includes openings registering with the upper openings and communicating oxygen and water inlet and outlet pipes. The lower connector assembly is provided to communicate with a vent passage provided at the lower end of the lance by means of a vent pipe which envelop the lower oxygen pipe and communicates with the atmosphere.

19 Claims, 10 Drawing Figures

OXYGEN LANCE ASSEMBLY

CROSS-REFERENCES TO RELATED PATENT APPLICATIONS

The instant patent application is related to the following five co-pending patent applications which were filed in the Patent Office on the same date as the instant application:

Ser. No. 795,243, filed May 9, 1977
Ser. No. 795,244, filed May 9, 1977
Ser. No. 795,245, filed May 9, 1977
Ser. No. 795,247, filed May 9, 1977
Ser. No. 795,248, filed May 9, 1977

BACKGROUND OF THE INVENTION

1. Field of the Invention

The invention relates to oxygen lances used in steel melting application within a basic oxygen furnace. More specifically it relates to a quick disconnect lance having improved venting provisions.

2. Description of the Prior Art

Patents of the prior art include U.S. Pat. No. 3,620,455 Nov. 16, 1971; 3,827,632 Aug. 6, 1974; 3,912,244 Oct. 14, 1975; RE: 28,769 Apr. 13, 1976 and 3,972,515 Aug. 3, 1976. This invention is an improvement over the aforementioned patents.

SUMMARY OF THE INVENTION

In the present invention a top support member is supported on a lance carriage for supporting the lance in connection with a B.O.F. furnace vessel. The support member includes an oxygen supply pipe communicating with an oxygen source and water inlet and outlet pipes. A first upper connector plate assembly is connected to the pipes and includes a lower flat surface. A plurality of openings in the surface provide communication with oxygen pipes and water pipes. A second lower connector plate assembly may be quickly disconnected and connected to the first connector assembly by clamping means. The second assembly also includes a flat plate having openings registering with the first openings when the connector plates are clamped together. The latter openings are in communication with lower oxygen and water inlet and outlet pipes which extend downwardly to the lance nozzle. Engaging flat surfaces of the plates are provided with O-ring seals to prevent the leakage of water into the oxygen pipes and from oxygen leaking into the water pipes. The oxygen pipe has a lower end which is in slip joint or sliding engagement with an oxygen stub pipe provided on the nozzle. The slip joint is of a telescoping type and includes suitable O-ring seals to prevent leakage. Both embodiments of the invention include a vent pipe or shroud which extends from the slip joint upwardly to the connector plate assemblies and communicates with a vent passage in one of said plate assemblies which is adapted to channel any leakage of oxygen or water outwardly to the atmosphere.

DESCRIPTION OF ONE EMBODIMENT

Figure 1:
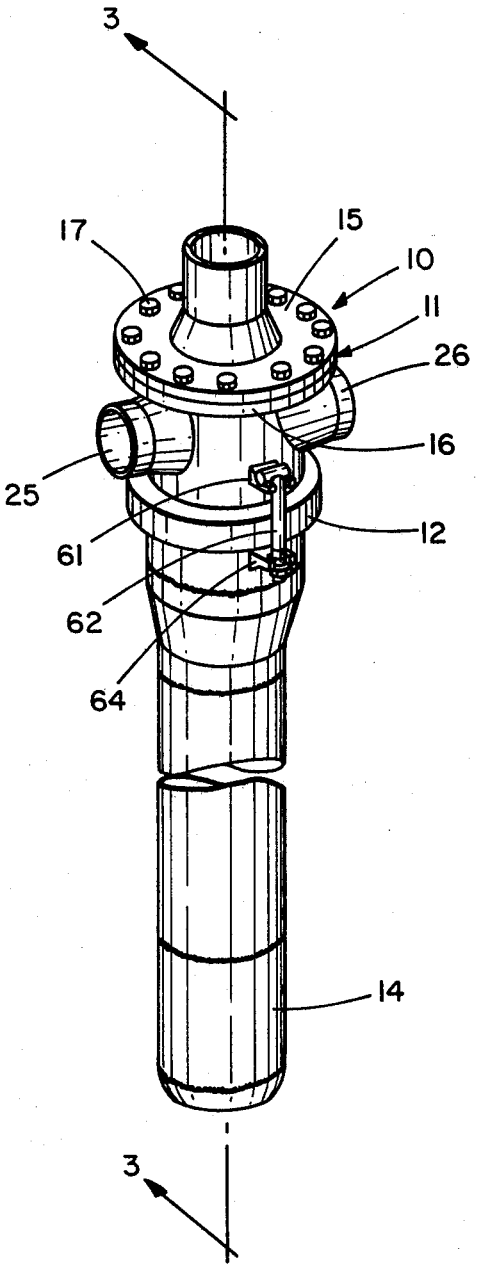
FIG. 1 is a perspective view of an improved lance assembly.

An oxygen lance 10 includes an upper head or support member 11, an upper and lower connector plate assembly 12 and 13 and a discharge nozzle 14 as best shown in FIG. 1.

The support member 11 is adapted to be rigidly connected to a lance carriage which supports the lance adjacent to a B.O.F. furnace in the steelmaking process. The head 11 includes a top plate 15, an attaching plate ring 16, connected by bolts 17 to the top plate 15.

A first oxygen pipe 18 communicates with an oxygen source 19 and is connected to the top plate 15 and to a first connector plate assembly 20. The assembly 20 includes a flat plate 21 having a lower flat surface 22. The head further includes second water inlet and third water outlet concentric pipes respectively 23 and 24.

A water inlet connection 25 communicates with the inlet pipe 23 and outlet connection 26 communicates with the outlet pipe 24. The connector plate assembly 20 includes a central oxygen opening 27 and is provided with a plurality of slots 28 and 29 supported on and through the plate 21. A second connector plate assembly 30 includes a flat plate 31 having an upper flat surface 32 which engages the lower flat surface 22 in relative clamping sealing relation. The plate 31 also includes openings or slots 33 and 34 respectively in registry with the slots 28 and 29.

A fourth oxygen pipe 35 is connected to the plate 31 and a central opening 36 in the plate 31 communicating with the first oxygen pipe 18. A fifth water inlet pipe 36' is supported on the plate 31 and a sixth water outlet pipe 37 is also supported on the plate 31. The pipes are concentric and the water inlet pipe 36' communicates with openings 28 and 33 and the water outlet pipe 37 communicates with openings 29 and 34.

Figure 9:
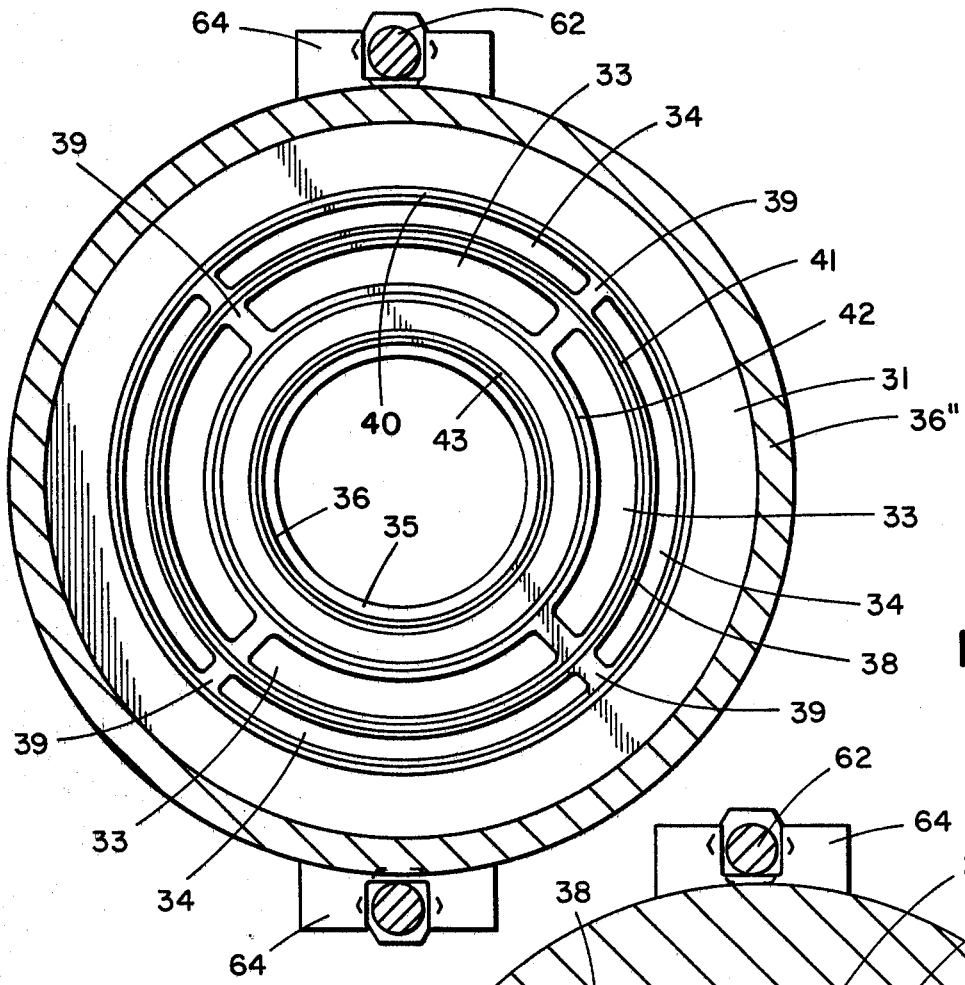
FIGS. 9 and 10 are plan sections taken at lines 9—9 and 10—10 in FIG. 3.
Figure 10:
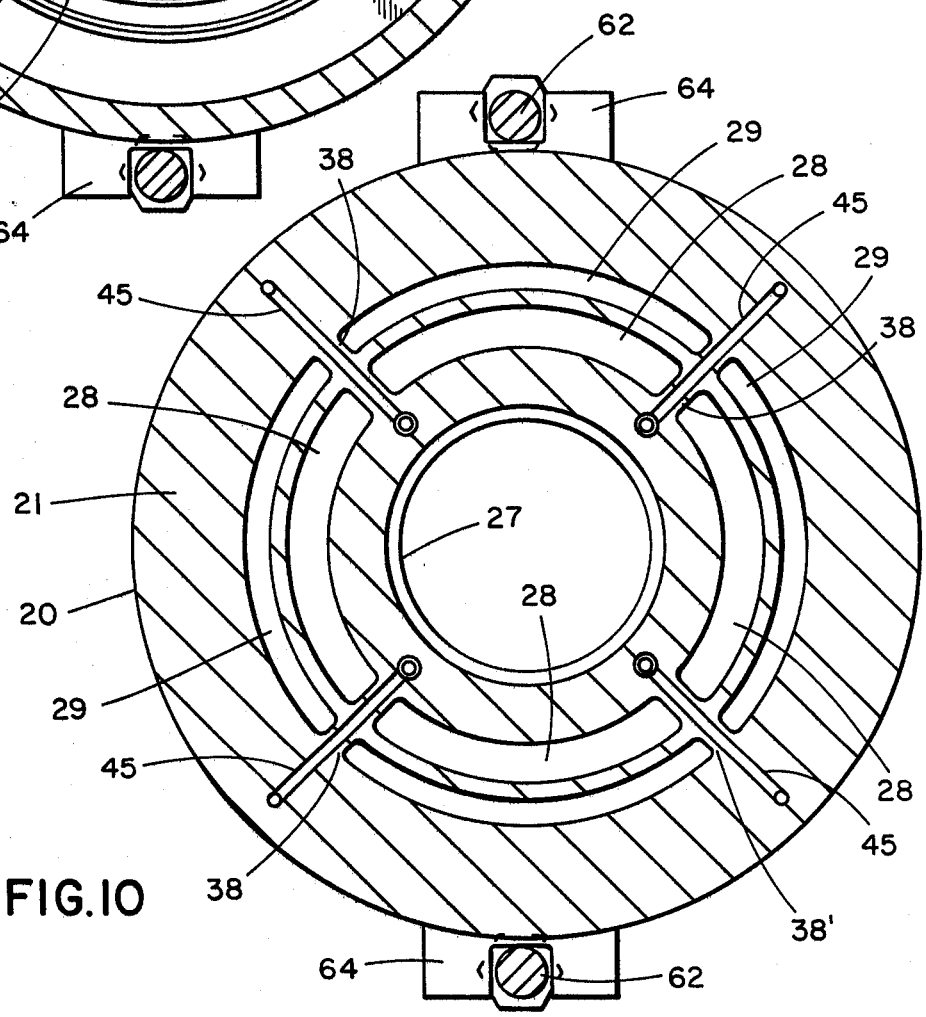

FIG. 10 discloses the positioning of openings or slots 28 and 29. FIG. 9 discloses the positioning of the complementary slots 33 and 34 which register with slots 28 and 29. The slots disclosed are of arcuate formation, annularly, or circumferentially spaced with their adjacent ends spaced horizontally to provide a plurality of spaced webs 38 in the plate 21, and 39, in the plate 31. The upper plate 21 also includes a peripheral downwardly extending flange 36" overlapping the plate 31.

The plate 31 also includes four radially spaced ring grooves containing O-rings 40, 41, 42, and 43 to seal the flat surfaces of the upper and lower plates, and particularly the areas between the openings 33 and 34 and 28 and 29.

As best shown in FIG. 10 the plate 21 is provided with a plurality of vent passages 45 extending horizontally and then vertically as indicated at 46 through the flange 36" to the atmosphere. The inner ends of the passage end in a vent chamber 47 which communicates with a bore 48 extending through the plate 31 whereupon it communicates with a shroud or vent pipe 49 having its upper end connected to a connector ring 50 which is also connected to pipes 36' and 37. The connector ring 50 is connected to the plate 31 by means of cap screws 50' which are easily removable to disengage ring 50 from plate 31.

The upper ends of pipes 36', 37 and vent pipe 49 are connected to the ring 50 by welding. The shroud pipe 49 envelopes the oxygen pipe 35 and extends downwardly adjacent the nozzle 14. The lower end of the pipe 35 is provided with an enlarged outer projecting sleeve or piston member 51 which includes a pair of vertically spaced O-rings 52 engaging and sealing the lower end of the shroud pipe 49.

The nozzle includes an orifice 53, a stub oxygen pipe 54 having a reduced outer diameter portion 54' which is in slip joint or telescoping relation with the piston member 51 at the oxygen pipe 35. The reduced diameter portion 54 includes two pairs of vertically spaced O-rings 55 and 56 engaging the piston portion 51 in sliding sealing relation.

An annular vent chamber 57 between the O-rings 55 and 56 is in communication with a bore 58 which communicates with the shroud pipe 49 venting leakage through the passages 48, 47, 45 and 46 to the atmosphere. Vertical contraction and expansion of the pipes 35 and 49 are achieved by the slip joint arrangement disclosed and which is occasioned by the variations in temperature. The nozzle 14 also includes a slip joint pipe stub 60 having a mechanical sliding connection with the lower end of the inlet pipe 36'. An O-ring 67 on ring 50 adjacent the connection of the shroud 49 to the right is in seal relation with the plate 31.

Figure 2:
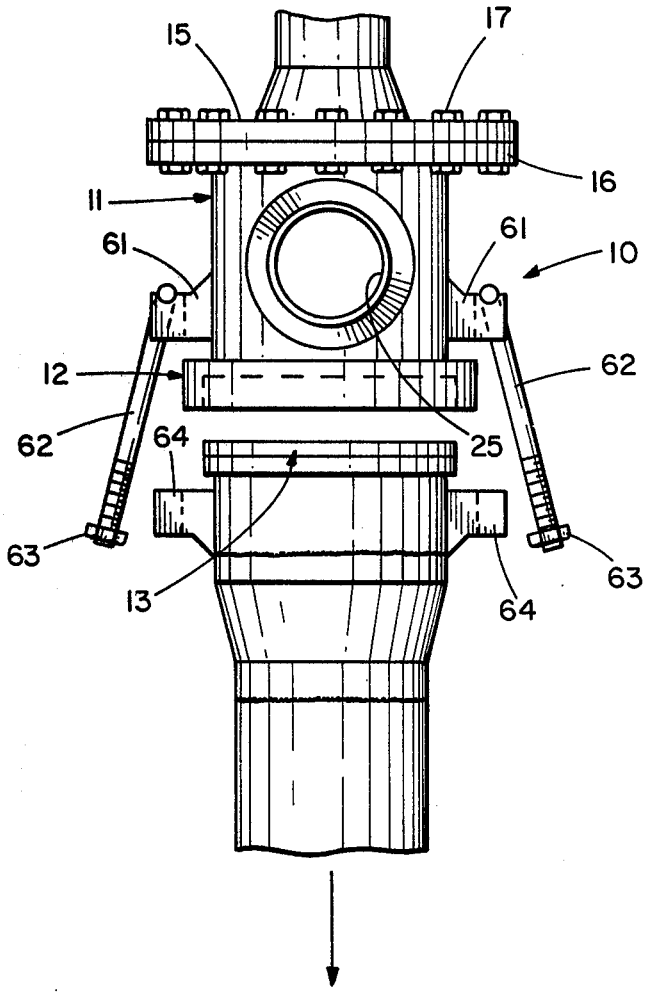
FIG. 2 is an elevational view of a top portion of the lance assembly shown in FIG. 1.
Figure 3:
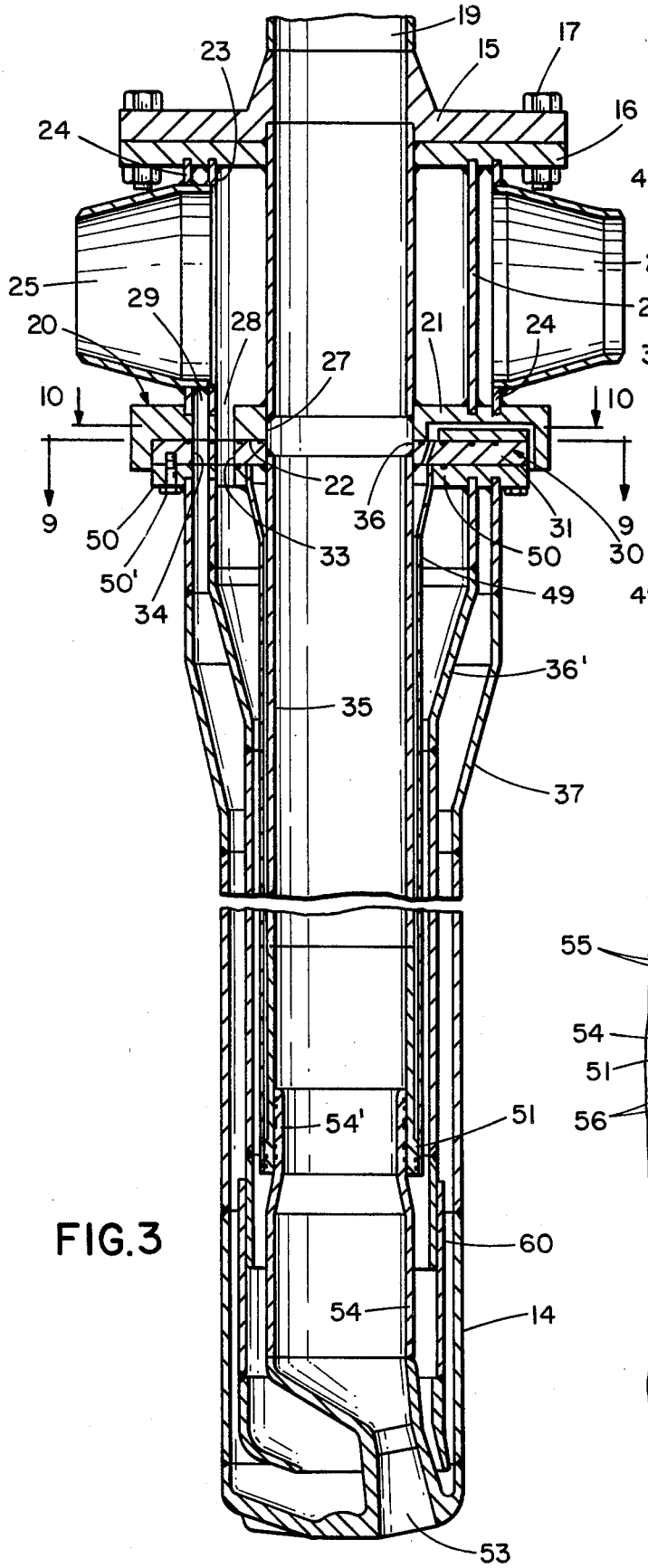
FIG. 3 is a cross-sectional view taken along the line 3—3 of FIG. 1.
Figure 4:
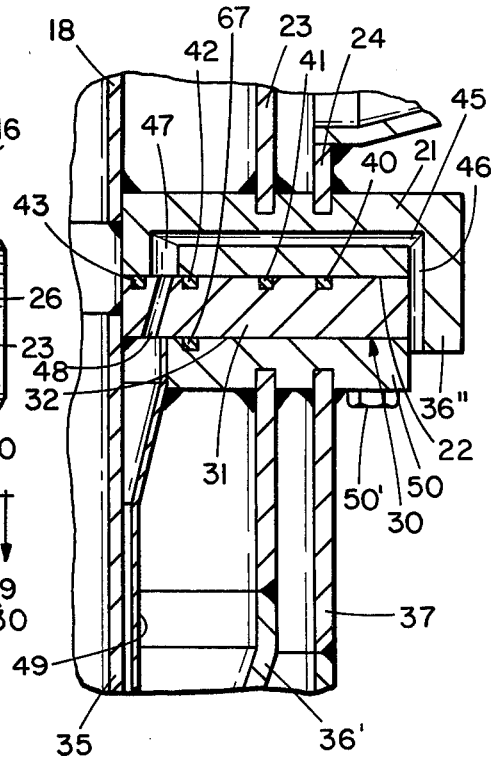
FIG. 4 is a partial cross-sectional view of a pair of connector plate assemblies.
Figure 5:
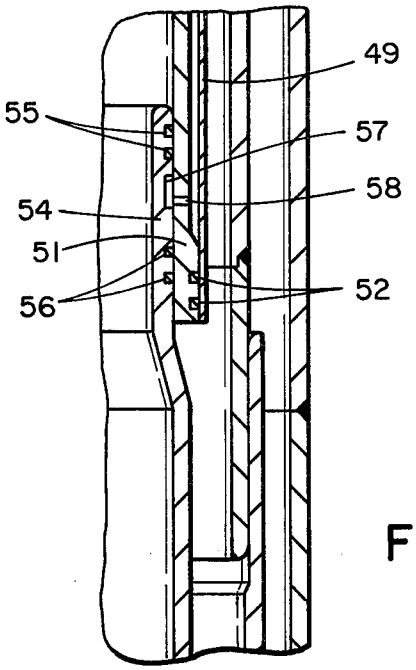
FIG. 5 is a cross-sectional view disclosing portions of a slip joint at the lower end of a lance assembly.

The quick connect and disconnect arrangement is disclosed in FIG. 2 and includes a pair of bosses 61 supported on pipe 24 which hingedly support bolts 62 having nuts 63 thereon.

The bolts 62 and nuts 63 engage slotted locking ears 64 to releasably lock the connector assemblies together.

DESCRIPTION OF ANOTHER EMBODIMENT

Figure 6:
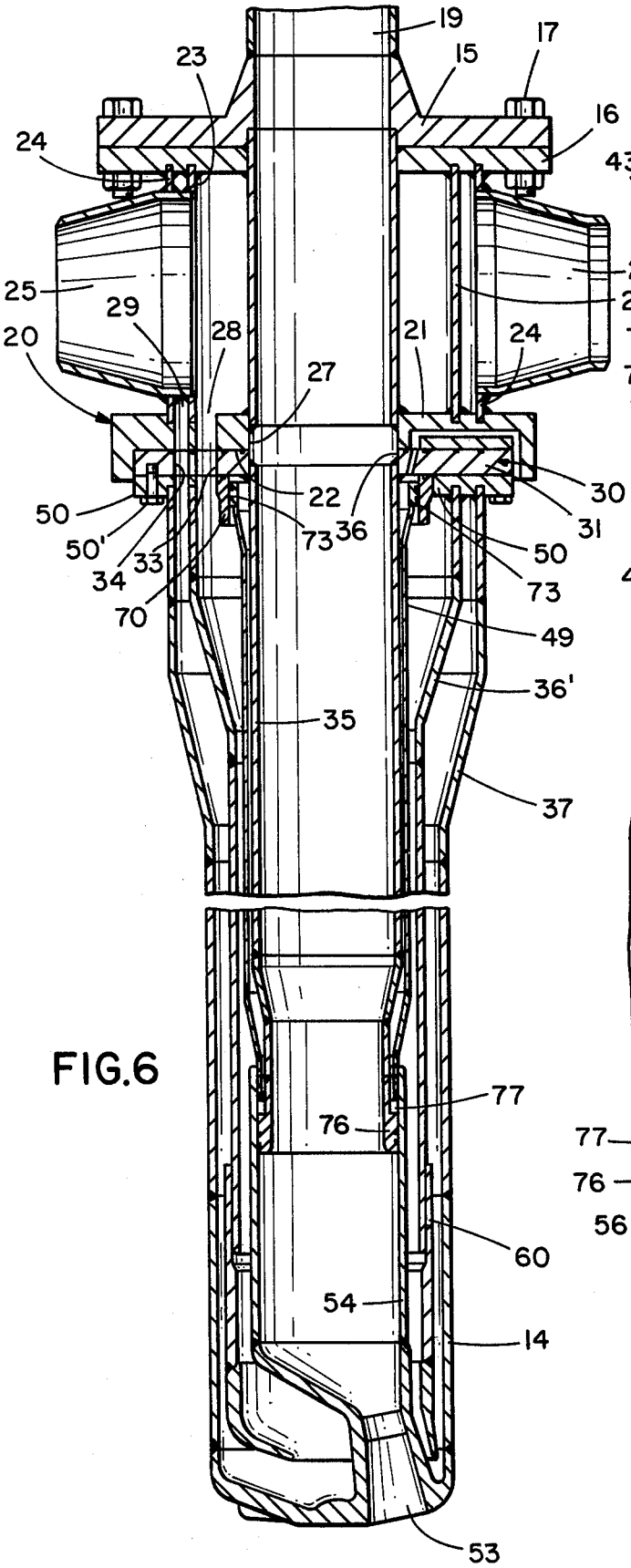
FIG. 6 is a view similar to FIG. 3 showing another form of the invention.
Figure 7:
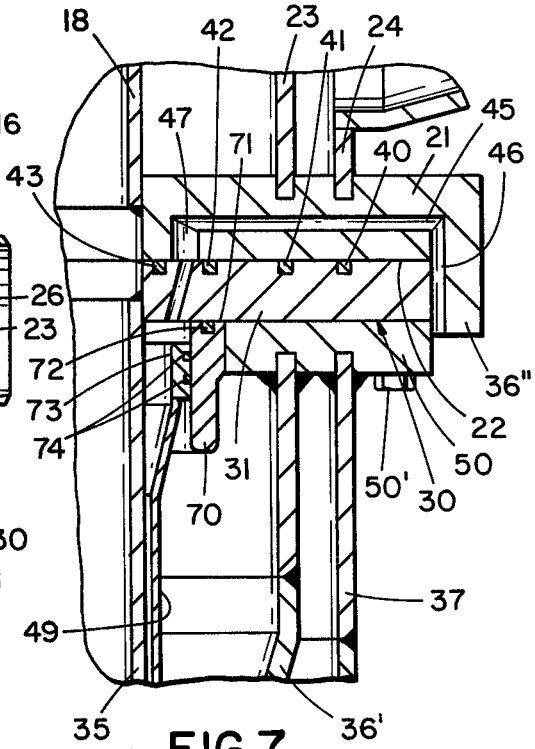
FIG. 7 is a detail view in cross section of a connector plate assembly.
Figure 8:
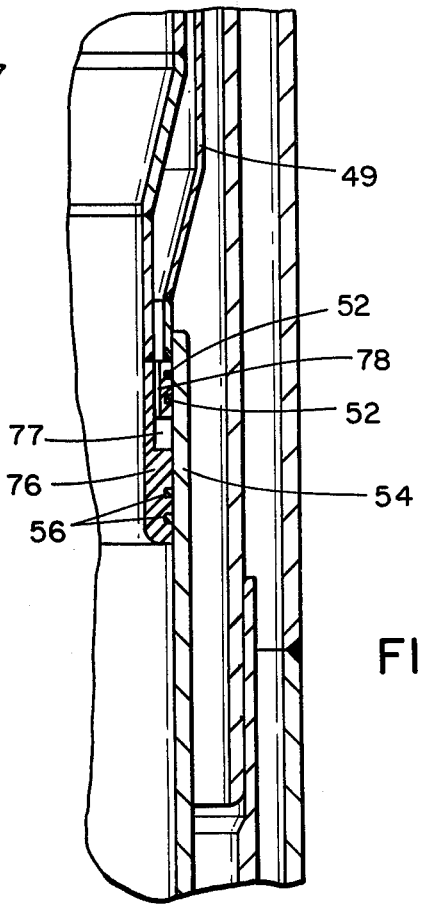
FIG. 8 is a detail cross-sectional view of a slip joint at the lower end of the lance shown in FIG. 6.

FIGS. 6, 7, and 8 show another form of the invention wherein the shroud pipe 49 at its upper end is slidingly connected to a sleeve 70 suitably connected to the ring 50. The sleeve 70 has its upper surface 71 in sealing engagement by means of an O-ring 72. The upper end of the shroud pipe 49 is provided with a piston end 73 having O-rings 74 in sliding relation with the sleeve 70. The lower end of the oxygen pipe 35 is provided with an enlarged piston portion 76 in sliding relation with the stub pipe 54 and having an annular venting groove or chamber 77 slidingly sealed against the stub pipe 54 by upper and lower O-ring pairs 52 and 56, respectively, and including a passage 78 communicating with the shroud pipe 49 which is secured to the upper portion of the piston portion 76.

This arrangement again permits expansion and contraction of the lower oxygen and vent pipes.

The same reference characters will apply where the parts are similar. Additional parts have above been additionally identified.

In the present invention in both instances the lances of both designs operate similarly in flowing oxygen to the nozzle. They are both of the quick disconnect type which can quickly be removed from the top support members for service. The venting arrangement provides for venting of the lowermost slip joint to vent any leakage of oxygen and water while at the same time providing for quick removal, repair or replacement of the tip assembly. The novel sealing arrangements are designed to prevent leakage of oxygen into the water or water into oxygen. If it does occur the novel vent arrangement disclosed will provide proper and immediate discharge to the atmosphere.

What is claimed is:

1. A steelmaking lance assembly comprising a top support member, said support member including a first central oxygen supply pipe and second and third concentric water inlet and outlet pipes, a first connector plate assembly on said top support member, said first connector plate assembly having a flat lower surface including a central opening communicating with said central oxygen pipe, a plurality of first openings in said lower surface, communicating with said second and third pipes, a second connector plate assembly having an upper flat surface including a plurality of second openings registering with said first openings, a fourth pipe connected to said second connector plate assembly and communicating with said first pipe, fifth and sixth water inlet and outlet pipes on said second connector plate assembly communicating with said second openings, a nozzle connected to said fourth, fifth and sixth pipes including, a central oxygen stub pipe, an outlet orifice communicating with said stub pipe, an inner water inlet stub pipe, an outer water outlet stub pipe, said water inlet and outlet stub pipes communicating with said fifth and sixth pipes, the lower end portion of said fourth oxygen pipe and oxygen stub pipe being inter-connected to provide a telescoping connection, a vent pipe connected to said second connector assembly, said vent pipe extending about said fourth oxygen pipe and being concentric therewith, vent passage means on one of said connector assemblies providing for communication of said vent pipe with the atmosphere, said vent pipe extending adjacent to said oxygen stub pipe, said lower end of said vent pipe being positioned relative to the telescoping connection of said fourth oxygen and stub pipes, to receive any leakage of oxygen from said telescoping connection and vent the same to the atmosphere.

2. The invention in accordance with claim 1, the lower end of said fourth oxygen pipe engaging said vent pipe in sealing relation, and passage means in said telescoping connection communicating with the lower end of said vent pipe.

3. The invention in accordance with claim 1, the lower end of said fourth oxygen pipe having an outer projecting circumferential shoulder, said lower end of said vent pipe engaging said shoulder, and seal means between said shoulder and said vent pipe.

4. The invention in accordance with claim 3, said oxygen stub pipe engaging said lower inner wall portion of said fourth oxygen pipe, and a vent opening through said lower inner wall communicating with said vent pipe.

5. The invention in accordance with claim 4, said telescoping connection including a vent chamber communicating with said vent opening and said vent pipe.

6. The invention in accordance with claim 2, including seal members between the upper end of said stub pipe and said lower end of said fourth oxygen pipe.

7. The invention in accordance with claim 4, including a plurality of seal members between said oxygen stub pipe and the lower end of said fourth oxygen pipe, and said vent chamber being positioned between said seal member and being of annular configuration.

8. The invention in accordance with claim 1, said first connector plate assembly having an outer peripheral flange projecting downwardly and overlapping said second connector plate assembly, said vent passage means including a passage in said second connector plate assembly communicating with said vent pipe, and a second passage communicating with said first passage and extending horizontally to within said first connector plate assembly.

9. The invention in accordance with claim 8, said second passage including a vertical portion projecting downwardly within said peripheral flange adjacent to said second connector plate assembly.

10. The invention in accordance with claim 1, said second connector plate assembly including an annular ring plate having a flat upper surface and a central opening through which said fourth pipe projects, said ring plate including a plurality of third water inlet and outlet openings communicating with said first and second water inlet and outlet openings, and means connecting said ring plate to a lower flat surface of said connector plate.

11. The invention in accordance with claim 10, said means connecting said ring plate to said lower surface including removable fasteners.

12. The invention in accordance with claim 10, said vent pipe having its upper end portion connected to said ring.

13. The invention in accordance with claim 10, including seal means between said upper surface of said ring plate and said lower surface of said second connector plate assembly.

14. The invention in accordance with claim 1, said second connector plate including a sleeve connected thereto and projecting downwardly in overlapping relation with respect to the upper portion of said vent pipe, said vent pipe having a collar connected to said upper portion, said collar having an outer peripheral wall engaging said sleeve in relative sliding relation.

15. The invention in accordance with claim 14, the lower end of said fourth oxygen pipe having an outer projecting circumferential shoulder engaging said inner surface of said oxygen stub pipe in relative sliding relation, and said lower end of said vent pipe having an annular second shoulder engaging said inner surface of said oxygen stub pipe in sliding relation.

16. The invention in accordance with claim 15, said annular second shoulder of said vent pipe having an innner surface laterally spaced from the outer peripheral surface of said fourth pipe adjacent the lower portion thereof.

17. The invention in accordance with claim 15, including a first seal means between said collar and said sleeve.

18. The invention in accordance with claim 17, including a second seal means between said circumferential shoulder and surface of said oxygen stub pipe.

19. The invention in accordance with claim 18, including third seal means between said second annular shoulder and the inner surface of said oxygen stub pipe.

* * * * *